US010087562B2

(12) United States Patent
Milini

(10) Patent No.: US 10,087,562 B2
(45) Date of Patent: Oct. 2, 2018

(54) STEAM TREATING PRINTED FIBROUS SHEET MATERIAL

(71) Applicant: MS Printing Solutions S.R.L., Caronno Pertusella (VA) (IT)

(72) Inventor: Luigi Milini, Saronno (IT)

(73) Assignee: MS Printing Solutions S.r.l., Caronno Pertusella (VA) (IT)

( * ) Notice: Subject to any disclaimer, the term of this patent is extended or adjusted under 35 U.S.C. 154(b) by 0 days.

(21) Appl. No.: 15/684,572

(22) Filed: Aug. 23, 2017

(65) Prior Publication Data

US 2017/0350054 A1 Dec. 7, 2017

Related U.S. Application Data

(63) Continuation of application No. PCT/IB2016/050900, filed on Feb. 19, 2016.

(30) Foreign Application Priority Data

Feb. 23, 2015 (IT) ..... MI2015A0260

(51) Int. Cl.

| | |
|---|---|
| ***B41J 11/00*** | (2006.01) |
| ***D06B 19/00*** | (2006.01) |
| ***B41F 15/12*** | (2006.01) |
| ***D06B 17/06*** | (2006.01) |
| *B65H 19/28* | (2006.01) |

(52) U.S. Cl.

CPC ..... *D06B 19/0035* (2013.01); *B41F 15/12* (2013.01); *B41J 11/002* (2013.01); *D06B 17/06* (2013.01); *B65H 19/286* (2013.01)

(58) Field of Classification Search

CPC ..... B41J 11/002; B41J 11/004; B41J 11/007; B41J 11/02; B41F 15/12; D06B 19/0035; D06B 17/06; B65H 19/286; B65H 29/247

See application file for complete search history.

(56) References Cited

U.S. PATENT DOCUMENTS

| | | | | |
|---|---|---|---|---|
| 3,838,968 | A | 10/1974 | Fleissner | |
| 3,949,577 | A | 4/1976 | Fleissner | |
| 3,981,680 | A | 9/1976 | Fletcher | |
| 4,070,877 | A | 1/1978 | Fleissner | |
| 6,471,729 | B1 * | 10/2002 | Voth | D06B 19/0035 68/5 D |

(Continued)

FOREIGN PATENT DOCUMENTS

| | | |
|---|---|---|
| DE | 2419611 | 1/1990 |
| EP | 0065058 A1 | 11/1982 |

(Continued)

OTHER PUBLICATIONS

International Search Report and Written Opinion for International Application No. PCT/IB2016/050900, dated May 19, 2016, 12 pages.

(Continued)

*Primary Examiner* — Thinh H Nguyen
(74) *Attorney, Agent, or Firm* — Fish & Richardson P.C.

(57) ABSTRACT

Steam-treating printed fibrous sheet material to fix ink printed on the material includes conveying the printed material into a steam chamber on a conveyor with a surface containing condensed water. At least some of the condensed water is transferred to the sheet material on the conveyor.

18 Claims, 14 Drawing Sheets

(56) References Cited

U.S. PATENT DOCUMENTS

| | | | |
|---|---|---|---|
| 7,089,767 | B2 | 8/2006 | Voth et al. |
| 2003/0033950 | A1 | 2/2003 | Matich |

FOREIGN PATENT DOCUMENTS

| | | | |
|---|---|---|---|
| EP | 0607762 | A1 | 7/1994 |
| GB | 1446381 | | 8/1976 |
| IT | MI2015A000260 | | 8/2016 |
| WO | WO2008031763 | | 3/2008 |
| WO | WO2016135602 | | 9/2016 |

OTHER PUBLICATIONS

Search Report and Opinion for Italian Patent Application n. MI2015A000260, dated Mar. 12, 2015, 8 pages.

* cited by examiner

STEAM TREATING PRINTED FIBROUS SHEET MATERIAL

CROSS-REFERENCE TO RELATED APPLICATIONS

This application is a continuation of and claims priority to PCT Application Serial No. PCT/IB2016/050900, filed on Feb. 19, 2016, the entire contents of which are incorporated herein by reference.

FIELD OF THE INVENTION

This invention relates to steam treating a sheet-shaped fibrous material, such as for fixing ink present on the sheet fibrous material after a previous printing step, and to methods and apparatus for such steam treatment.

BACKGROUND

As known, both conventional printing—using printing silk-screen cylinders or frames—and digital-type printing—using one or more printing nozzle heads—are technologies used for applying inks or paints defining motives, patterns, colorations on sheet materials of different kind, such as for example paper, fabrics, non-woven fabrics, felt, etc.

Fabrics or other fibrous materials having a laminar structure, such as of materials made of non-woven fabric, destined either to traditional and digital printing, may be subjected to a series of fabric preparing steps, before printing, and to one or more fabric finishing steps, after the printing step. In some applications, before the printing process the material to be printed must be accurately prepared so that the surface to be printed is reasonably devoid of impurities, is hydrophilic, is arranged in a plane, the warp and weft thereof have been rectified (in case of fabrics) and it has been suitably stabilized from a dimensional point of view.

After the preparing step, the fibrous material is printed by using, for example, (flat or rotating) silk-screen printing techniques and/or digital printing techniques. After the printing step, the printed material is dried and then is subjected to an ink fixing process typically performed by suitable devices (sometimes referred to as "steam treatment devices" or "steam agers") in which the printed material is held in a steam environment under suitable pressure and temperature conditions in order to fix the ink to the material fibers. Then, the fabric is washed and dried again.

Fixing ink often requires particular conditions: the presence of water in a vapour state, a suitable thermal level, and minimizing as much as possible the oxygen quantity. These requirements have led to exclude: the use of hot air systems due to their high oxygen concentration, the use of water since is capable of dissolving the printing, and the use of chemical solvents since they are expensive and often toxic and therefore difficult to be disposed of. Therefore, many commercially available steam fixing devices are configured to determine the vapour and temperature conditions necessary for correctly fixing the ink on the fabric.

Two main types of steam treatment devices: discontinuous and continuous, are known. The discontinuous devices provide a treatment chamber adapted to receive a determined quantity of a material, for example a printed fabric, and therefore supplied by steam: all the fabric is kept still in the treatment chamber for a predetermined period of time necessary for fixing the ink. At the end of the treatment, the chamber is discharged and the fabric is withdrawn to be taken to a drying station. While the discontinuous steam treatment devices enable to fix the ink on the fabrics, these however are not devoid of limitations and inconveniences. Particularly, the discontinuous treatment (load batch) makes the process slow and therefore unsuitable for high industrial production rates. It is also noted that repeatedly opening the chamber between one treatment and the following—for discharging the treated fabric and loading a new fabric—makes the process highly expensive from an energy point of view; at each opening of the vaporizer, the vapour and temperature conditions necessary for fixing the ink on the fabric are lost: in order to quickly restore the vaporizer to the required treatment conditions, high power consumption is required. Such conditions, besides further slowing the process, heavily affect operating costs and therefore negatively affect the cost of the resulting treated products.

The continuous devices are provided with a treatment chamber. Inside the chamber the treated material, for example a fabric, is moved at a predetermined speed in order to maintain the printed material in the chamber for a time sufficient to enable the ink fixing process. Particularly, the fabric is introduced into the chamber and abutted on a plurality of elements called "sticks" enabling hanging the fabric in a series of apposed loops: the sticks slowly advance inside the treatment chamber so that the steam can fix the ink on the fabric. Then, the fabric is taken to an outlet station to withdraw the fabric from the sticks and guide it outside the vaporizer.

Illustratively, a type of continuous steam treatment device is, for example, described in German patent application No. DE2419611. The vaporizer exhibits a case in which first and second fixing chambers are defined. In the first chamber, a conveyor belt receives the fabric arriving from outside the case and guides it towards the fixing chamber: the conveyor belt is upwardly sloped so that the fabric can be taken to a top area of the case. Then, the fabrics is caused to fall from the belt onto a series of sticks that receives the fabric and places it according to a series of opposed loops. The sticks are caused to slowly advance inside the second chamber so that the steam can suitably fix the ink.

A different configuration of the continuous device is described in patent publication No. WO2008031763A1: in this case, the vaporizer exhibits, in the treatment chamber, a series of horizontal belts on which the fabric is laid in order to define a plurality of loops: the belts are slowly moved inside the chamber so that the steam can fix the ink on the fabric. Further, the vaporizer has an inlet station admitting to the chamber formed by a sloped conveyor belt which is partially placed outside the chamber (portion receiving the fabric) and partially inside this latter (portion supplying the fabric to the horizontal belts inside the treatment chamber). All the conveyor belts, in other words both the sloped belt operating adjacent the inlet station and the horizontal belt inside the treatment chamber, exhibit a fabric abutment surface having through holes.

The described continuous devices enable quickly treating huge quantities of fabric or of other fibrous material to be treated: the fixing process is quicker than the discontinuous vaporizers and therefore generally less expensive. It is also noted that the housing of the steam chamber remains always substantially closed: in this way, it is possible to hold the chamber fully operative under the desired steam conditions, with substantial power savings with respect to the discontinuous vaporizers that, on the contrary, require continuous "thermal re-shootings" at the end of each treatment.

DEFINITIONS

In the following description the listed terms have the following, specific meanings:

Ink: a mixture formed by a dispersion of pigments or by a solution of dyes in an aqueous or organic medium destined to be transferred on surfaces of different materials for obtaining one or more prints.

Fibrous material: a material consisting of fibers of a variety of types—for example a fabric, a non-woven fabric, a knitted fabric, or combinations of such fabrics.

Sheet fibrous material: a fibrous material formed in a structure having two dimensions (length and width) having both a markedly prevalent extension with respect to a third dimension (thickness). The term "sheet fibrous material" means both a fibrous material in discrete sheets having limited lengths (for example the formats A0, A1, A2, A3, A4, etc.), and continuous bands exhibiting a marked length which can be supplied by a roll on which the sheet material is reeled or can come from a direct printing step. In any case, the sheet fibrous material, herein described, exhibits two sides, or main surfaces, at least one of which may be printed or printable.

Hydrophilic material: a material capable of absorbing and/or retaining water.

Digital printing: a printing using one or more nozzles printing heads for applying inks defining motives, patterns, colorations, etc., on sheet materials. The printing heads can be movable transverse to the sheet material advancement direction, in order to cover the overall width to be printed, or can be transversally stationary, in case the effective head width is equal to the printing width.

Standard environment: an environment at a temperature of 288.15 K (15° C.), pressure of 101.325 kPa (1 atm), and humidity of 0.00.

SUMMARY

According to one aspect of the invention, a printed fibrous sheet material steam treatment apparatus includes a casing defining at least one steam-treatment chamber and having at least one inlet port, configured for enabling introduction of a fibrous sheet material into the treatment chamber, and at least one outlet port configured for enabling the treated fibrous sheet material to exit from the treatment chamber. The apparatus also includes at least one conveyor configured to contactingly receive the fibrous sheet material and convey the material into the treatment chamber through the inlet port, the conveyor being positioned with respect to the inlet port so as to constantly present a first conveyor portion disposed outside the treatment chamber and a second conveyor portion extending inside the treatment chamber. The conveyor includes at least one absorbing surface arranged to contact the fibrous sheet material as placed on the conveyor, the absorbing surface being configured to capture condensate water.

In some examples, the conveyor has an active surface arranged to contactingly receive the fibrous sheet material and which extends along a closed path, and the absorbing surface has at least one continuous absorbing layer extending along all the closed path of the active surface of the conveyor. In some cases, the conveyor comprises a conveying belt or a conveying drum.

In some embodiments, at least the absorbing surface of the conveyor has, or is formed of, a fibrous material having a dry specific weight less than 1 $kg/m^2$ per 1 mm of thickness, as measured in a standard environment at a temperature of 288.15 K (15° C.), pressure of 101.325 kPa (1 atm), and humidity of 0.00.

Preferably, the absorbing surface has a water absorption capacity greater than 25%, by weight, of a dry weight of the absorbing surface, per unit volume.

In some examples, each 0.5 $cm^3$ of volume of the absorbing surface defines a plurality of recesses in the form of at least one of pores, channels extending through an entire thickness of the absorbing surface, and interstices extending only partially through a thickness of the absorbing surface, with a plurality of the recesses open on an exposed surface of said absorbing surface.

In some cases, the surface is of a hydrophilic material.

In some examples, the conveyor is a conveyor belt engaged as a closed loop about at least a first idler roll outside the treatment chamber and a second idler roll inside the treatment chamber, the conveyor belt including at least one upper belt section extending between the first and second idler rolls and arranged to contact and convey the fibrous sheet material into the treatment chamber, and at least one lower belt section.

In some embodiments, the first and second idler rolls are configured to rotate about respective horizontal axes parallel to each other and placed at different heights, with the rotation axis of first idler roll is lower than the rotation axis of the second idler roll, such that the upper belt section is inclined at an angle of more than five degrees with respect to a horizontal plane. A longitudinal extent of the second portion of the conveyor, measured parallel to an advancement direction of the conveyor, is preferably greater than a longitudinal extent of the first portion of the conveyor.

In some cases, the apparatus includes at least one material guide disposed inside the treatment chamber and configured to receive the fibrous sheet material from the conveyor and to guide the fibrous sheet material along an operative path inside the treatment chamber, from proximate the conveyor to the outlet port.

In some examples, the guide includes a fibrous sheet material collector configured to arrange the fibrous sheet material entering treatment chamber into one or more bends, a fibrous sheet material mover downstream of the collector along a predetermined operative path of the fibrous sheet material, the mover configured to receive and advance the bends of sheet material along a predetermined direction, and a discharger configured to receive fibrous sheet material exiting the mover and to guide the fibrous sheet material out of the casing through the outlet port.

In some embodiments, the apparatus includes at least one steam generator configured to generate and supply steam to the treatment chamber. The steam generator is preferably configured to generate saturated steam and to maintain inside the treatment chamber a temperature between 100 and 130° C., and to maintain inside the treatment chamber an absolute pressure between 1 and 1.7 bar.

Another aspect of the invention features a method of fixing ink on a fibrous sheet material having at least one printed side. The method includes conveying printed fibrous sheet material into a steam-treatment chamber on a conveyor having an absorbing surface, the printed fibrous sheet material carrying an ink;

steam fixing the ink to the fibrous sheet material in the steam-treatment chamber, by guiding the fibrous sheet material along a predetermined operative path between an inlet port and an outlet port of the chamber, thereby treating the fibrous sheet material; and extracting the treated fibrous sheet material from the outlet port. The method also includes pre-humidifying the fibrous sheet material outside the steam-treatment chamber, by bringing the fibrous sheet material into contact with the absorbing surface of the conveyor, the absorbing surface containing condensate water, and transferring into the fibrous sheet material at least a portion of the condensate water from the absorbing surface.

In some examples, the conveyor contactingly receives and conveys the fibrous sheet material into the steam-treatment chamber through the inlet port, while constantly presenting a first conveyor portion disposed outside the treatment chamber and a second conveyor portion extending into the treatment chamber. During the pre-humidifying, the fibrous sheet material is brought into contact with the absorbing surface of the first conveyor portion, and the portion of condensate water is transferred into the fibrous sheet material while the fibrous sheet material is conveyed by the conveyor.

In some embodiments, consecutive parts of the absorbing surface are cyclically made to move into the treatment chamber, where an environment of saturated steam penetrates the surface portion; move out of the treatment chamber, where water condenses to form liquid water contained within the absorbing surface; and to contact the fibrous sheet material and transfer at least a portion of the condensed water from inside the absorbing surface to the fibrous sheet material.

In some cases, the fibrous sheet material has two main opposite sides and is printed on only one of said sides, such that the fibrous sheet material has an unprinted side placed in direct contact with the absorbing surface.

In some examples, steam fixing includes introducing steam into the treatment chamber, including controlling introduction of steam into the treatment chamber to maintain a temperature between 100 and 130° C., and an absolute pressure between 1 and 1.7 bar.

In some embodiments, steam fixing includes receiving pre-humidified fibrous sheet material into the treatment chamber; withdrawing the received fibrous sheet material by a material collector; delivering, by the collector, the withdrawn fibrous sheet material to a mover that guides the sheet material along the predetermined operative path; and withdrawing the fibrous sheet material from the mover by a discharger that guides the treated fibrous material from the treatment chamber through the outlet port.

Further aspects and advantages will be apparent from the following description, and from the claims.

DETAILED DESCRIPTION

Figure 1:
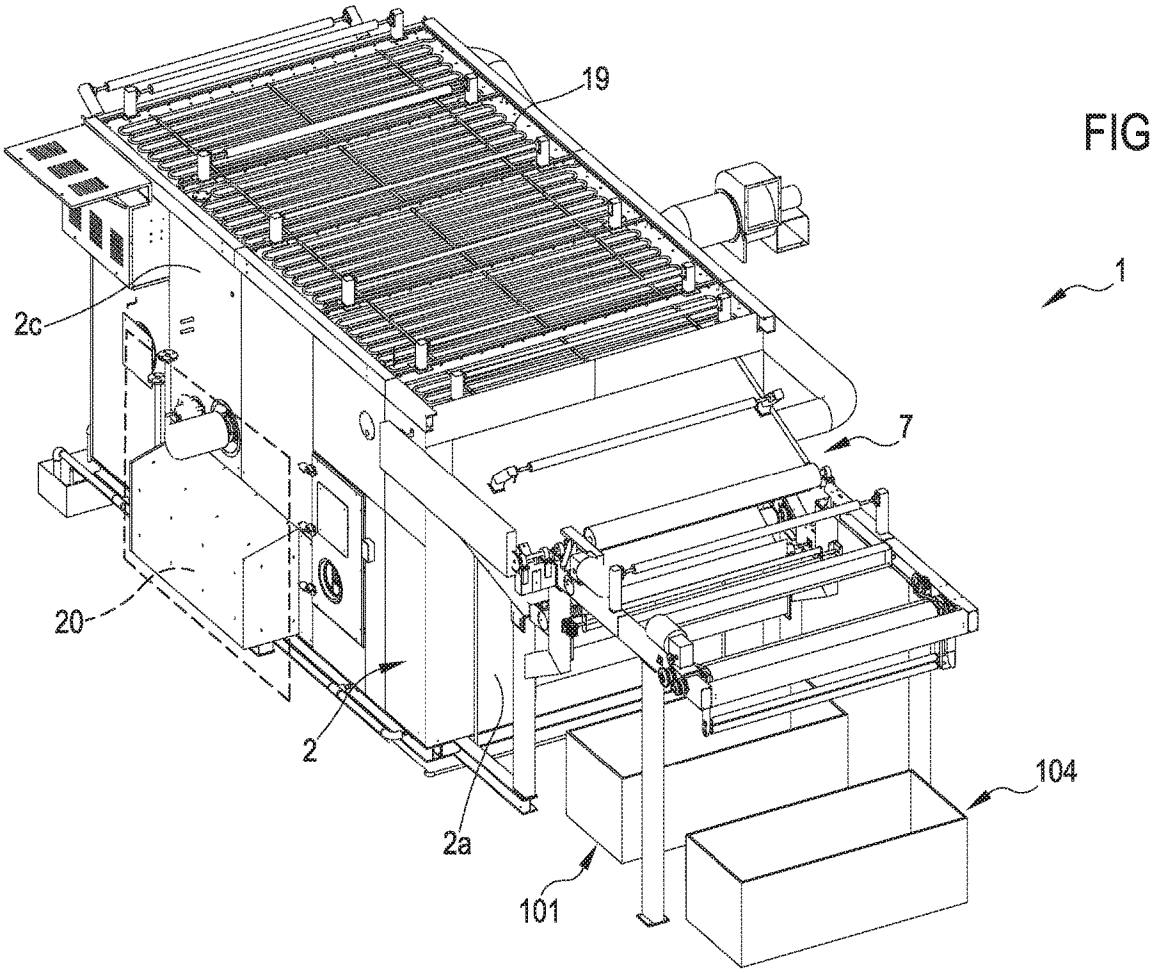
FIG. 1 is a perspective view of a steam treatment device.

Steam-treatment device 1 is useable for fixing inks applied after one or more printing processes, for example a digital or silk-screen printing. As visible, for example, in FIGS. 1-3, the steam-treatment device 1 has at least one casing 2 defining a steam-treatment chamber 3: the steam introduced or generated in the chamber 3 enables to fix the printed ink and/or paint on the material T. As shown, casing 2 defines a type of containing body delimited at the bottom by a base 18—which can comprise one or more structures constrained to an abutment floor of the device 1, such as plates, flanges, tracks, etc.—from which one or more side walls perimetrally emerge; further, the casing 2 comprises a closure wall 19, opposite to the base 18, which is stably engaged at the top of the lateral walls. The casing 2 exhibits, for example, a parallelepiped shape: the casing 2 in this case extends along a prevalent development direction coinciding with an advancement direction of the material T inside the same casing 2. In the illustrated example, the casing 2 has first and second transversal lateral walls 2*a*, 2*b* (FIG. 2)—defining the transversal extension of the casing—which are joined to first and second longitudinal lateral walls 2*c*, 2*d* (FIG. 3) defining the longitudinal extension of the casing.

Figure 2:
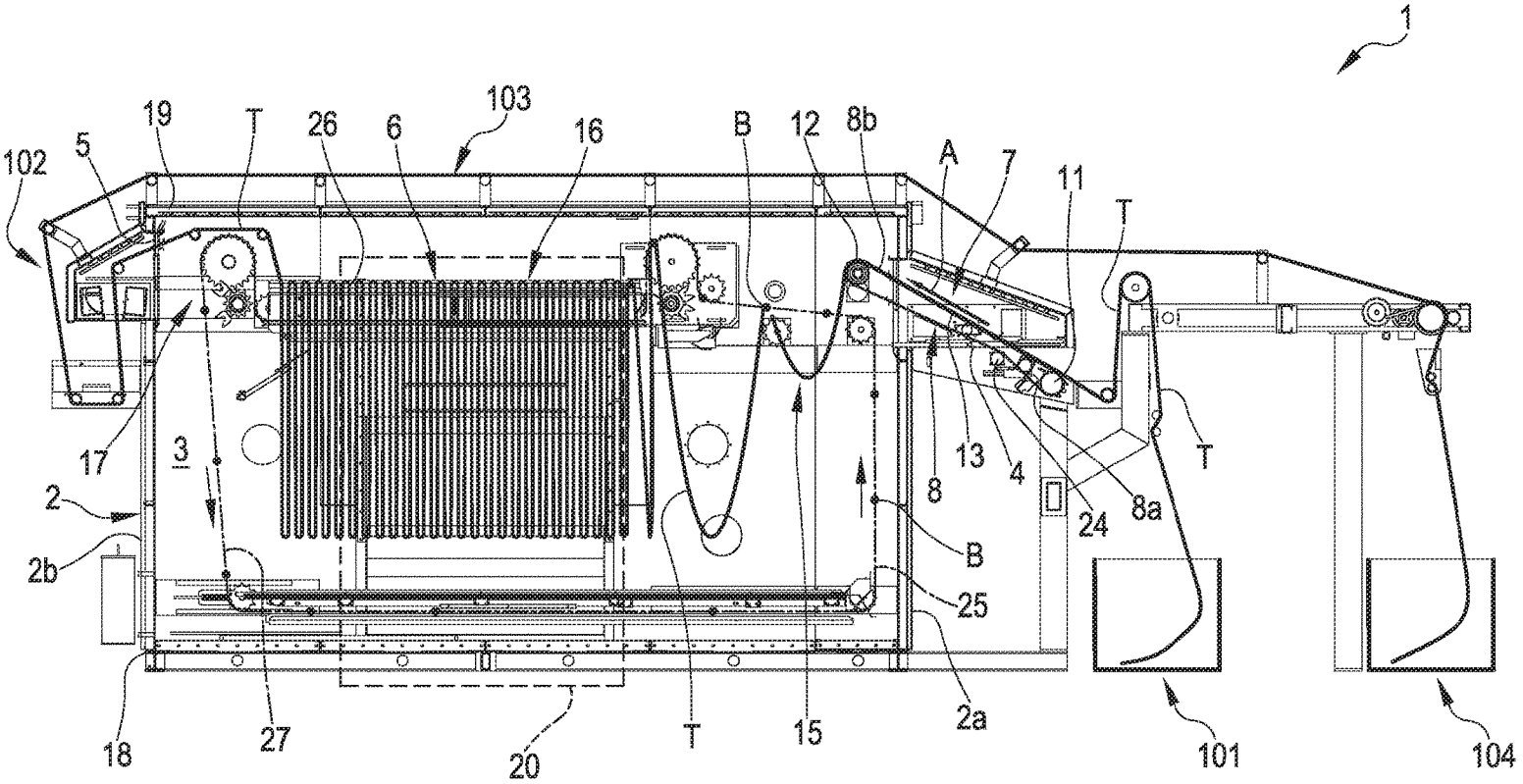
FIG. 2 is a schematic longitudinal cross-section view of the device in FIG. 1 during a step of treating a sheet fibrous material.
Figure 3:
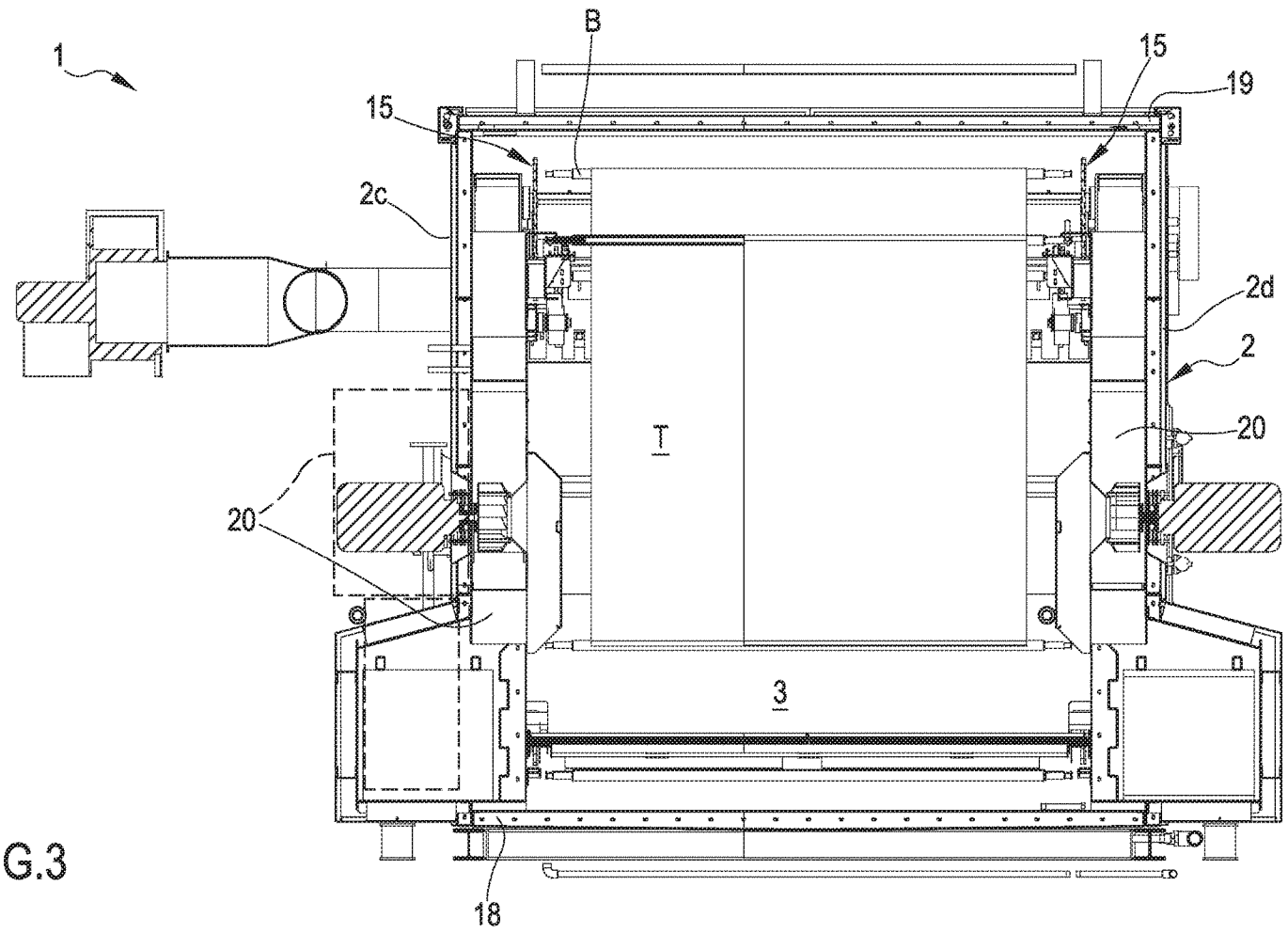
FIG. 3 is a schematic cross-section view of the device in FIG. 1 during the step of treating a sheet fibrous material.

As visible in FIG. 2, casing 2 has at least one inlet port 4 defining an opening that enables the introduction of the sheet fibrous material T, and at least one outlet port 5 defining an opening opposite to the inlet port 4 through which the sheet fibrous material T exits. Particularly, as it is visible in FIG. 2, the inlet port 4 is disposed on the first transversal wall 2*a* of the casing 2, and defines at least one through opening that can be, for example, shaped as a slit. In other words, it can exhibit a substantially horizontal prevalent development direction in order to enable the material T to enter while minimizing the leak of steam from the treatment chamber 3. As is visible in the attached figures, the inlet port 4 is placed at a predetermined height with respect to the base 18; for example, the inlet port 4 can be placed in the upper half of the transversal wall 2*a*, optionally in proximity of the closure wall 19 of casing 2 and therefore substantially at the top of the same. As discussed, the casing 2 further has an outlet port 5 placed on the second transversal lateral wall 2*b* and also shaped as a slit: under the operative conditions of the steam-treatment device, the outlet port 5 exhibits a substantially horizontal prevalent development direction, whose dimensions are such to enable the material T to pass through without simultaneously having a substantial steam leak from the treatment chamber 3. As visible in the attached figures, the outlet port 5 is placed at a predetermined height with respect to the base 18: for example the outlet port 5 can be placed in the upper half of the transversal wall 2*b*, optionally placed in the proximity of the closure wall 19 of casing 2 and therefore substantially at the top of the same.

Figure 4:
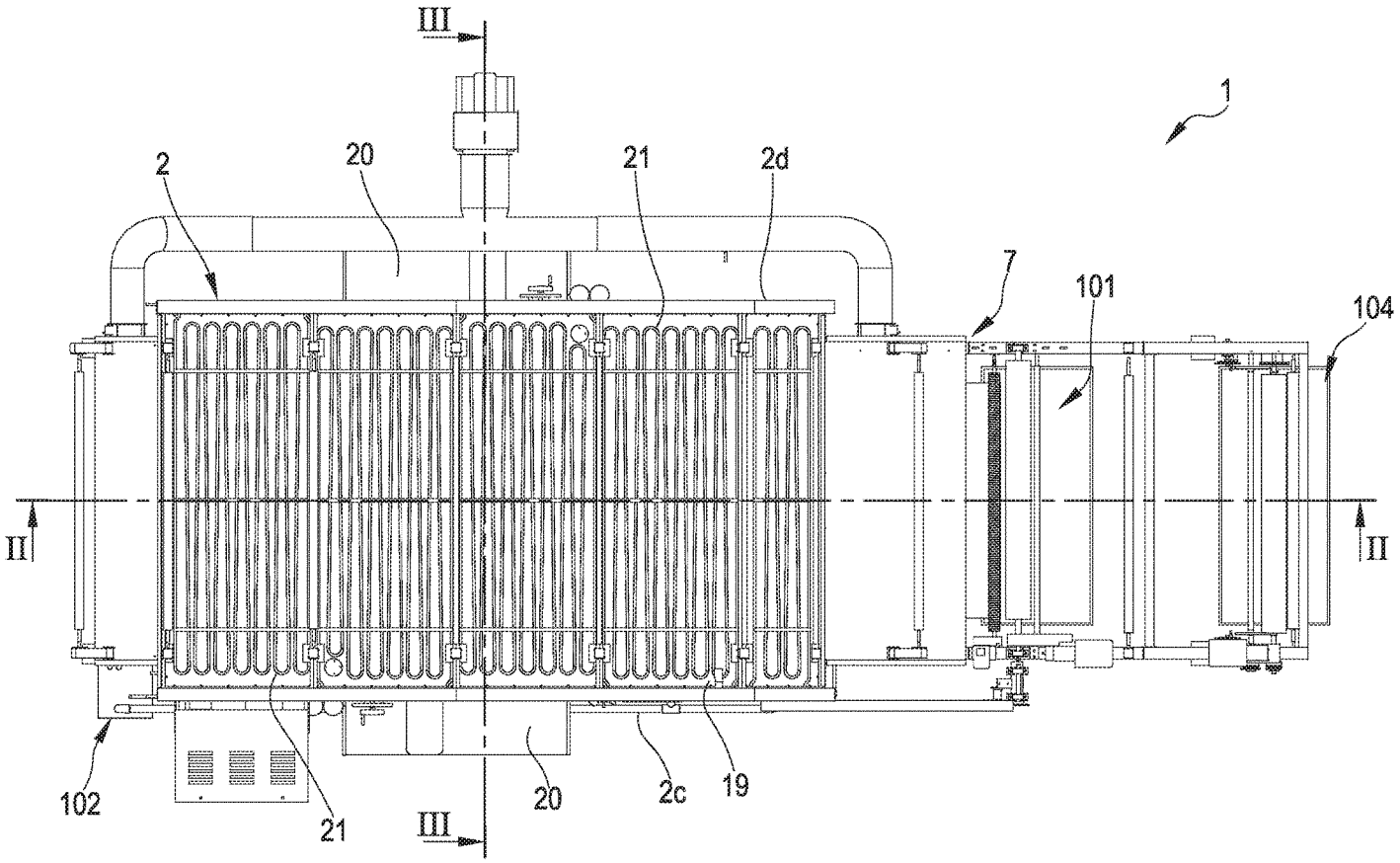
FIG. 4 is a top view of the device in FIG. 1.

As will be better described below, for suitably fixing the ink on fibrous material T, the same must be retained inside an environment, in other words the steam-treatment chamber 3, in which a saturated steam condition prevails. Under these conditions, there is a determined risk that during the fixing step, water drops could form inside the chamber: to this end it is observed that if drop-shaped water should contact the printed sheet material T, the same water could damage the print made on the material. In one example, therefore, the device 1 includes—at the closure wall 19 of the casing 2—a heating system 21 that heats wall 19 at least during the fibrous material T treatment. Heating wall 19 prevents condensate drops from forming on an inner surface of wall 19, typically extending above the operative path along which the material T is guided during the treatment inside the chamber 3: in other words, by means of heating system 19 the formation of drops is prevented, which could fall on material T passing inside casing 2. FIGS. 1 and 4 represent a heating system 21 including a series of electric resistances uniformly distributed above the closure wall 19, and placed according to one or more serpentine curves. As an alternative to electrical resistances, a system of hot fluid conduits adapted to suitably heat wall 19, or a heating system of another type, can be provided.

Further, steam-treatment device 1 includes at least one steam generator 20 that produces and delivers steam to the treatment chamber 3 of casing 2. In this example, generator 20 is at least partially placed inside the treatment chamber 3 at the first longitudinal lateral wall 2*c* (FIG. 1): the steam is directly generated in the treatment chamber 3. Alternatively, the generator can include a boiler outside the treatment chamber 3 and a conduit capable of delivering steam to the chamber itself. As illustrated in the cross-section view in FIG. 3, however, steam-treatment device 1 can include a further steam generator 20 placed on the second longitudinal lateral wall 2*d*: in such case two steam generators placed on respective longitudinal lateral walls of casing 2 opposite to each other can be provided: in such configuration, the generated steam comes directly in contact with the fibrous material T moving in the treatment chamber 3. The steam generator 20 provides a saturated steam at a temperature between 100 and 130° C., particularly between 100 and 120° C., still more particularly between 100 and 110° C. The generator 20 introduces steam into the chamber 3 and maintains inside the treatment chamber 3 an absolute pressure between 1 and 1.7 bar, particularly between 1 and 1.5, still more particularly between 1 and 1.2 bar. In one suitable example, the temperature in the chamber 3 is maintained between 100 and 110° C., while absolute pressure is maintained between 1 and 1.2 bar. Introducing steam from generator 20 into the treatment chamber 3 provides, during the steam fixing step, a saturated steam condition having a ratio comprised between 0.5 and 1. As visible in FIGS. 1 and 2, steam-treatment device 1 includes at least one inlet system 7 placed at the first transversal lateral wall 2*a* of the casing 2, and configured for receiving and guiding the fibrous material T inside the treatment chamber 3 through the inlet port 4; more specifically, as shown in FIG. 2, the inlet system 7 includes at least one conveying element 8 having an active surface arranged to contact and receive the sheet fibrous material T, which extends and is moved along a closed path: for example, the conveying element can be a conveying belt or a conveying drum or another element having an active surface defining a closed path.

Figure 5:
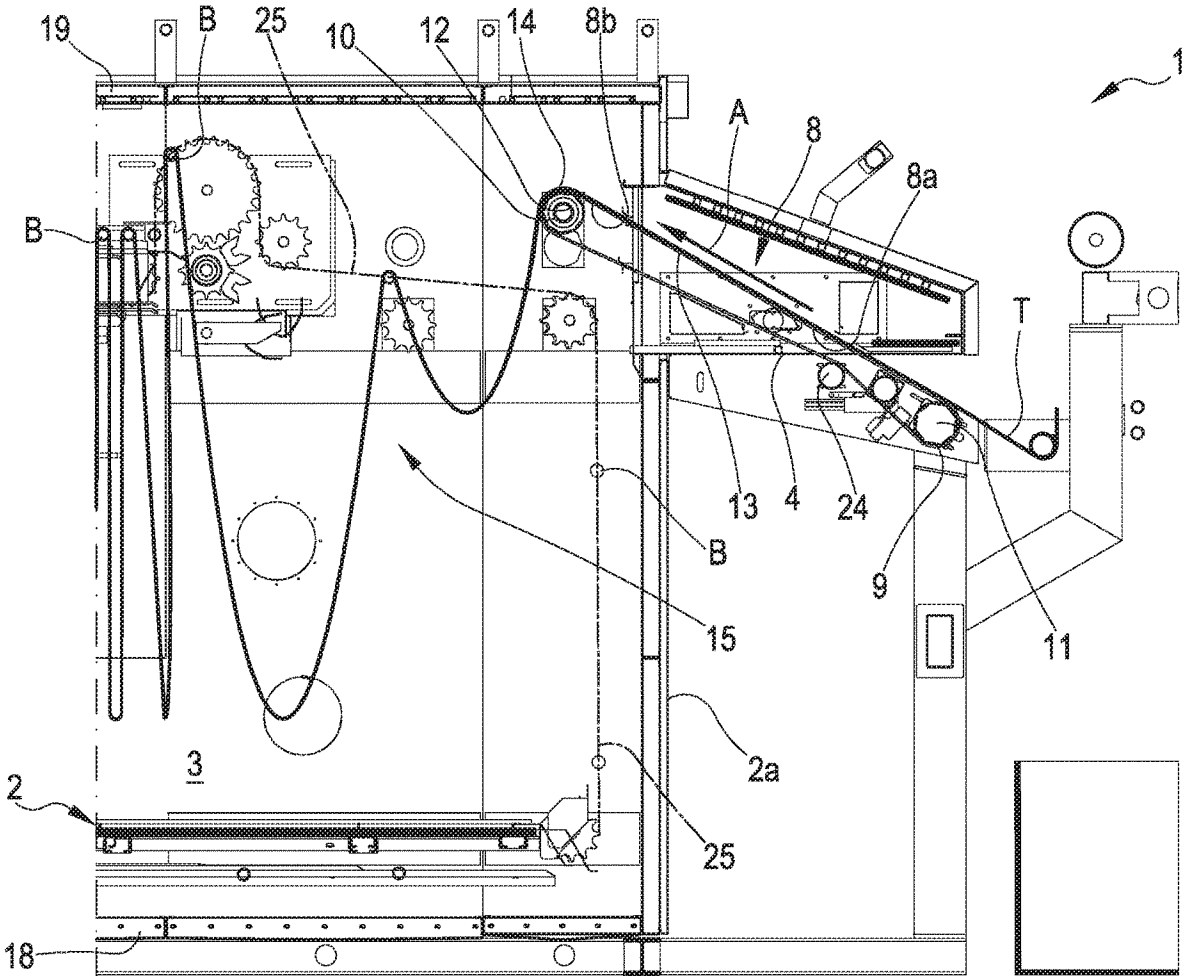
FIGS. 5 to 7 are longitudinal cross-section views relative to a part of the device in FIG. 2, under different operative conditions.

The conveying element 8 is configured and positioned with respect to the inlet port 4 in order to constantly define at least one first portion 8*a* placed outside the treatment chamber 3 and a second portion 8*b* extending inside the treatment chamber 3: since the conveying element is arranged along a closed loop, the first and second portions comprise, at each instant, consecutive parts of the conveying element, which continuously enter and exit the treatment chamber 3. At each instant, the first and second portions 8*a*, 8*b* of the conveying element 8 define together a closed perimetral path: such portions can exhibit the same perimetral extension (measured along the movement direction of the conveying element) or, as illustrated in the attached figures, a different perimetral extension. For example, as shown in FIGS. 2 and 5, the casing 2 can include a front hood receiving a main part of the conveying element 8 so that the longitudinal extension of the second portion 8*b* of the conveying element 8, measured parallel to an advancement direction A—in other words parallel to the lateral edges—of the conveying element, is greater than the longitudinal extension of the first portion 8*a*; particularly, the ratio of the longitudinal extension of the second portion 8*b* of the conveying element 8, to the longitudinal extension of the first portion 8*a*, is greater than 1.5, particularly greater than 2, still more particularly between 2.5 and 5. The disparity of the portions 8*a*, 8*b* extensions causes each point of the conveying element during the movement at a constant speed of the element 8 to be part of the second portion 8*b* for a time longer than the time during which the point is part of the first portion 8*a*.

Advantageously, the conveying element 8 has at least one absorbing surface portion 22 adapted to contact the sheet fibrous material T placed on the conveying element when the same material T is conveyed towards the steam-treatment chamber 3. The absorbing surface portion 22 has at least one absorbing continuous layer extending all along the closed path of the active surface of the conveying element itself.

Optionally, the absorbing surface portion 22 has at least one absorbing continuous layer having a constant thickness and a constant width, exhibiting an exposed surface defining the overall active surface of the conveying belt. Its structure and position enable the absorbing surface portion 22 to capture condensate water and transfer it to the fibrous material, which is thereby moisturized before entering the chamber 3; more particularly, since the element 8 is placed and moves along a closed path (and as said it constantly exhibits a first portion 8*a* outside the chamber and a second portion 8*b* inside the chamber 3), also the absorbing surface portion moves along the same closed operative path. This causes the absorbing surface portion, in one step, to come in contact with the saturated steam environment in the chamber 3 and, in a further step, to come in contact with the much cooler external environment, which causes the formation of condensate on and in the absorbing surface portion. De facto, the structure of the surface portion 22 enables absorption of water vapor at the surface portion part that, during element 8 movement, enters the chamber 3; along the part of the closed path outside the chamber 3, the absorbed water vapor and any water in the gas phase present adjacent the surface portion 22, condense at the same surface portion 22.

The absorbing surface portion of the conveying element comprises or substantially consists of a fibrous material (FIGS. 7B and 7C)—such as fabric, non-woven fabric, knitted fabric, felt—and/or of a cellular or porous material (FIG. 7A)—such as for example a spongy material. Composite alternatives, in which the surface portion is formed by a combination of plural elements, for example plural overlapped layers, each made of a fibrous material such as fabric, non-woven fabric, knitted fabric, felt or a cellular or porous material, are also envisioned.

The surface portion is made of materials having a relative low specific weight, because a substantial portion of the volume occupied by the absorbing surface portion (in dry conditions) is actually filled by air. Specifically, the dry specific weight (in standard conditions) of the material forming the absorbing surface portion 22 is less than 1 kg/m$^2$ per 1 mm of thickness, optionally less than 0.5 kg/m$^2$ per 1 mm of thickness; the dry specific weight is measured in a standard environment at a temperature of 288.15° K (15° C.), pressure of 101.325 kPa (1 atm), and humidity of 0.00.

As to its capacity for retaining water, the surface portion 22 is constructed such that a unit volume has the capacity of absorbing a water weight greater than 25% than the dry weight of the same unit volume; the dry weight of the unit volume (for example a patch of 1 dm$^2$ having a thickness of 1 mm of a material composing the surface portion) is measured in a standard environment at a temperature of 288.15° K (15° C.), pressure of 101.325 kPa (1 atm), and humidity of 0.00; the water weight quantity absorbed by the unit volume is measured by considering the same unit volume of the material forming the surface portion and causing it to absorb water to a saturation level and placing such unit volume on a horizontal weighing plane. Weight is measured under an equilibrium condition, with the weight value read 10 minutes after placing it on the weighing plane. The weighing is also performed in a standard environment. The measured weight minus the dry weight is the water weight absorbed by the unit volume.

In a variant, the surface portion 22 is constructed such that a unit volume of the absorbing surface portion exhibits the capacity of absorbing a water weight at least 50%, preferably 70% to 300%, greater than a dry weight of the same unit volume.

From the structural point of view, each reference volume equal to 0.5 $cm^3$ (half cubic centimeter) of the surface portion 22 exhibits plural (for example, 5 or more) recesses—as previously discussed—in order to maximize the interface surface between the absorbing surface portion and the external environment and therefore to increase the capacity of receiving condensate water. According to the physical structure of the surface portion, the recesses can be porosities, channels passing through the overall thickness of the absorbing surface portion, or interstices partially crossing the thickness of the absorbing surface portion. In any case, for each reference volume equal to 0.5 $cm^3$ of the surface portion 22, some of such recesses can directly face each other at the exposed surface of the same absorbing surface portion.

Preferably, the fibrous material of the surface portion comprises, or is formed by, a hydrophilic material. For example, preferably at least 30% by weight, more optionally at least 50% by weight, of the absorbing surface portion are formed by a hydrophilic fibrous material. In one example, the absorbing surface portion is a continuous layer of a textile material or of a non-woven fabric or a felt completely formed by hydrophilic material fibers.

De facto, the surface portion 22 of the element 8 is configured to trap water vapor, receiving condensate water and consequently pre-humidifying the fibrous material T when the material contacts the portion 22 and is moved for entering the chamber 3. The surface portion 22 contacting the relatively dried fibrous material T releases the liquid to the material T, which absorbs a portion due to the contact of the same on the element 8, for example by capillarity: the material T is then introduced in the chamber 3 under a pre-humidified condition.

In the illustrated examples, the conveying element 8 is configured to move the sheet fibrous material T along a predetermined advancement direction A entering the casing 2 treatment chamber 3. The absorbing surface portion 22 extends along all the closed path of the element 8, and, preferably, for the full width of the conveying element 8, defined normal to the advancement direction A of the sheet fibrous material T. The surface portion 22 is thus capable of evenly pre-humidifying the material T resting on the element 8. However, it is not excluded the possibility of defining the absorbing surface portion 22 by a plurality of distinct absorbing islands spaced from each other, optionally evenly distributed on the conveying element 8.

In one example, the conveying element 8 also has a base portion 23 (FIG. 7A and FIG. 7B) supporting and constraining the absorbing surface portion 22: under operative conditions, the absorbing surface portion is interposed between the sheet fibrous material T and said base portion, while the base portion 23 is positioned in order to directly contact the sheet fibrous material T. De facto, the base portion 23 comprises a layer, for example continuous and devoid of openings, only adapted to engage and support the surface portion 22. For example, the base portion 23 can advantageously comprise a continuous layer of a waterproof material, for example made of silicon or silicon rubber. Vice versa, FIG. 7C shows an example where the conveying belt 8 is only formed by the absorbing surface portion 22 and does not have a base portion.

The attached figures illustrate an example of the conveying element 8 in the form of a conveying belt. The conveying belt is engaged as a closed loop between at least one first idler roll 11 placed outside the treatment chamber 3 and a second idler roll 12 placed inside the treatment chamber 3, defining at least one upper section 13 of the conveying belt, extending between the first and second idler rolls 11, 12 and at least partially adapted to contact the sheet fibrous material T and convey it inside the treatment chamber 3, and at least one lower return section of the belt, which substantially forms the return branch of the conveying belt itself. As shown in the attached figures, the conveying belt further defines an arc-shaped joining segment 14, having generally a circular outline, placed at the second idler roll. The joining section 14 extends as a continuation of the upper section and is at least partially contacts the sheet fibrous material T by guiding it to make it fall towards the interior of the treatment chamber, in which additional material T conveying systems can operate.

Figure 6:
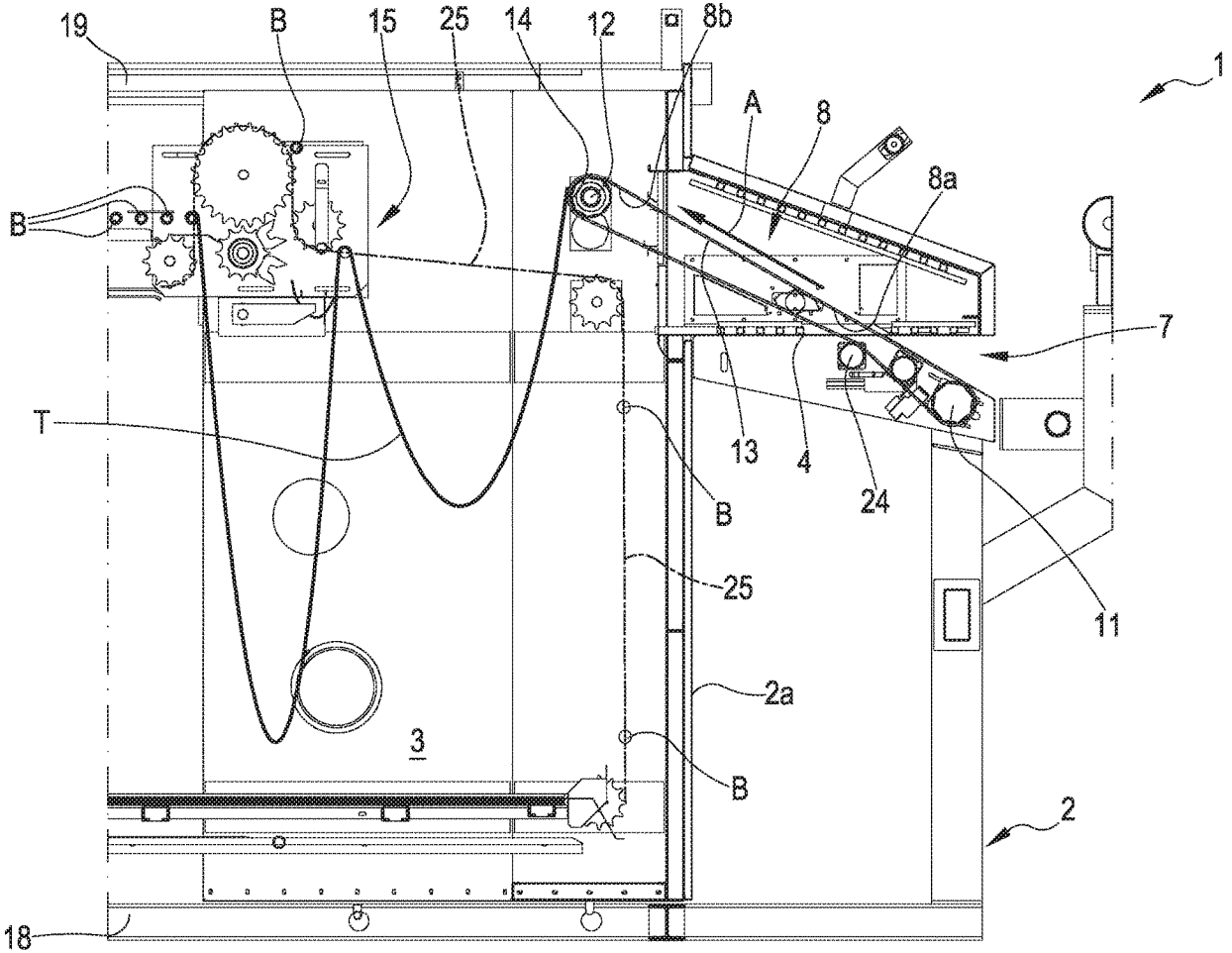
Figure 7:
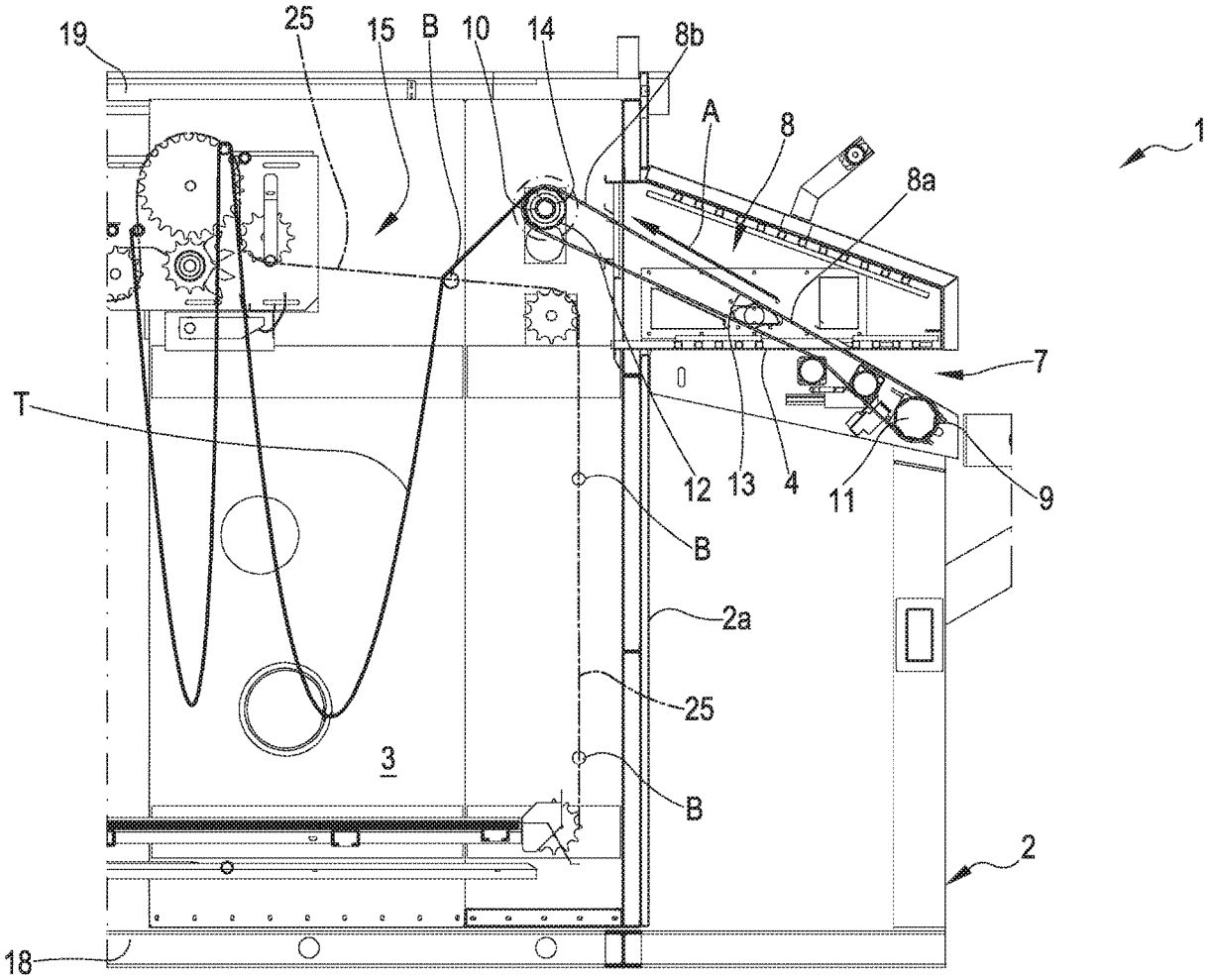
Figure 7A:
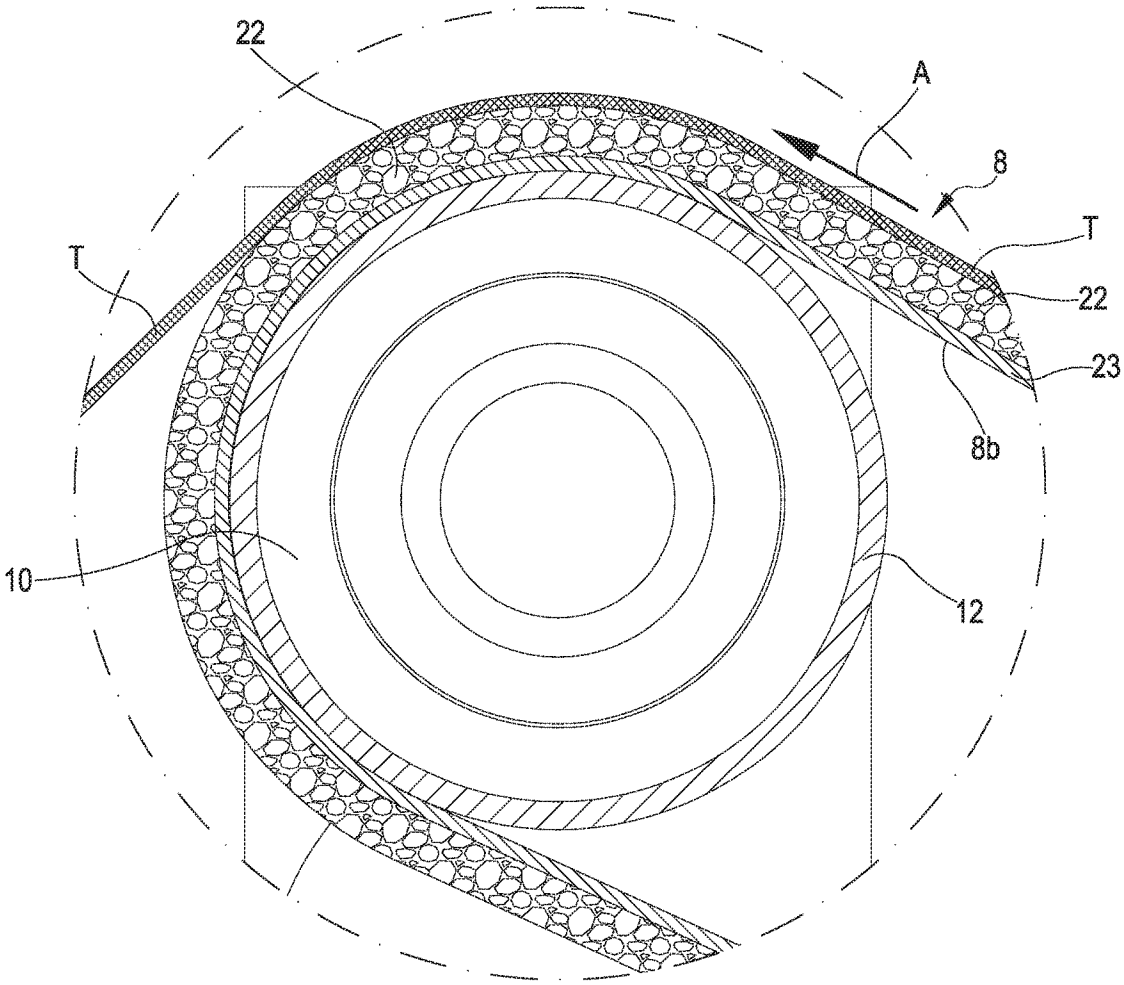
FIGS. 7A-7C refer to three variants of a conveying element associated to the device.
Figure 7B:
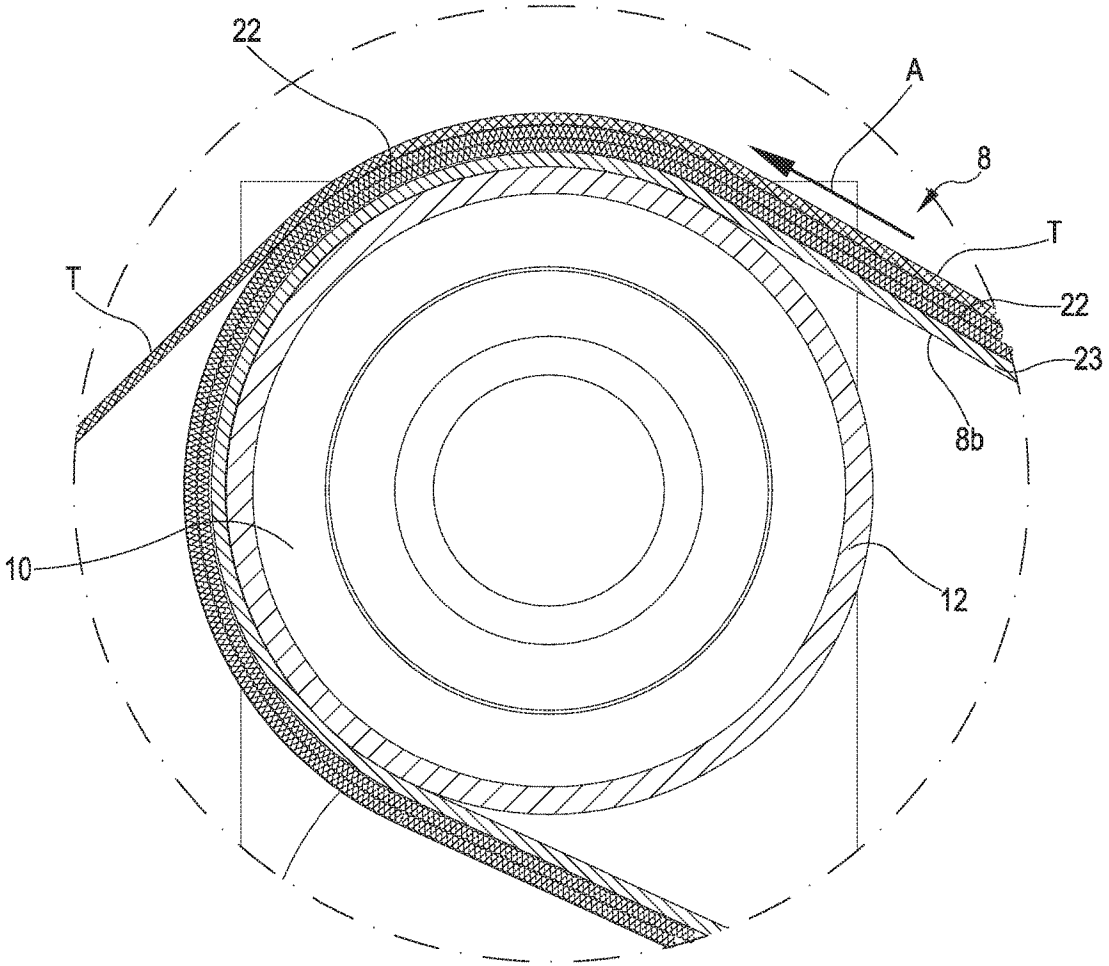
Figure 7C:
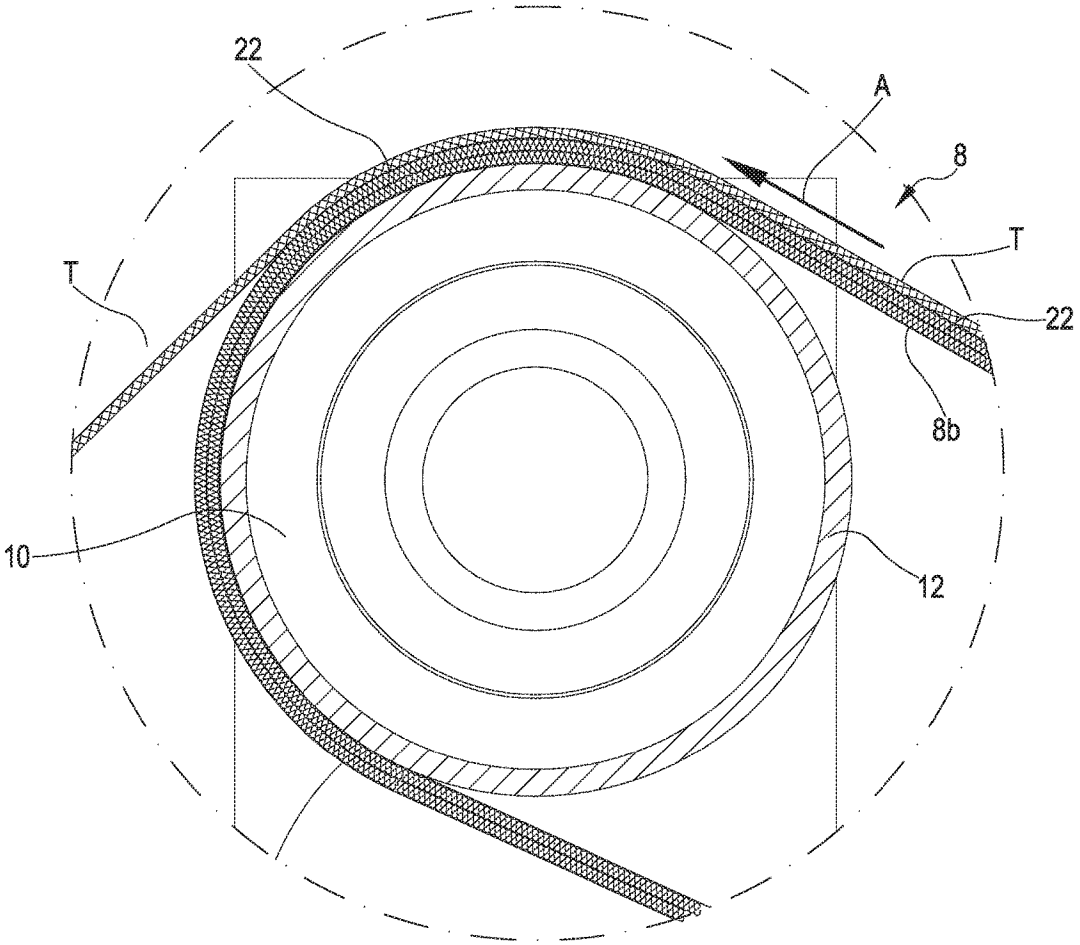
Figure 8:
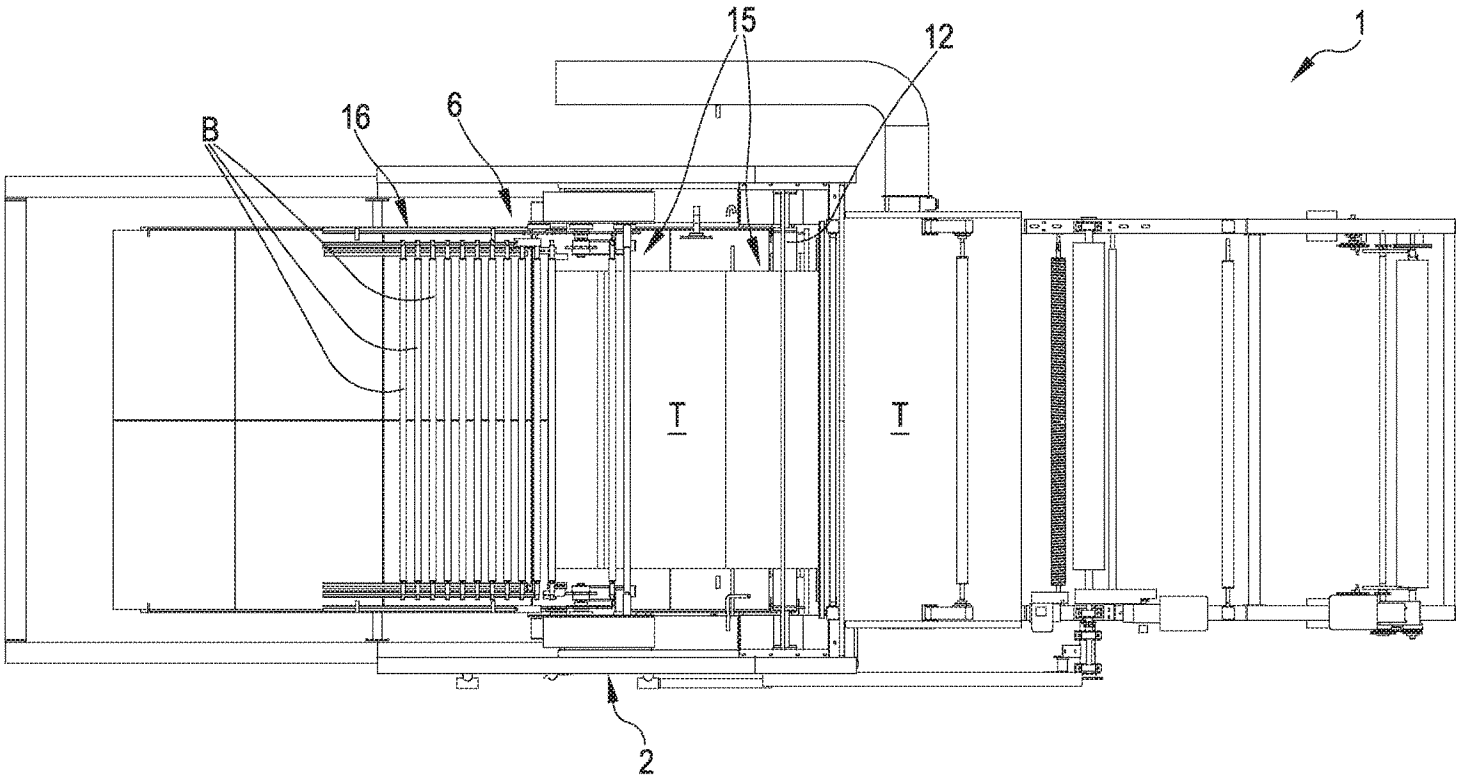
FIG. 8 is a top section plane of the device in FIG. 1.
Figure 9:
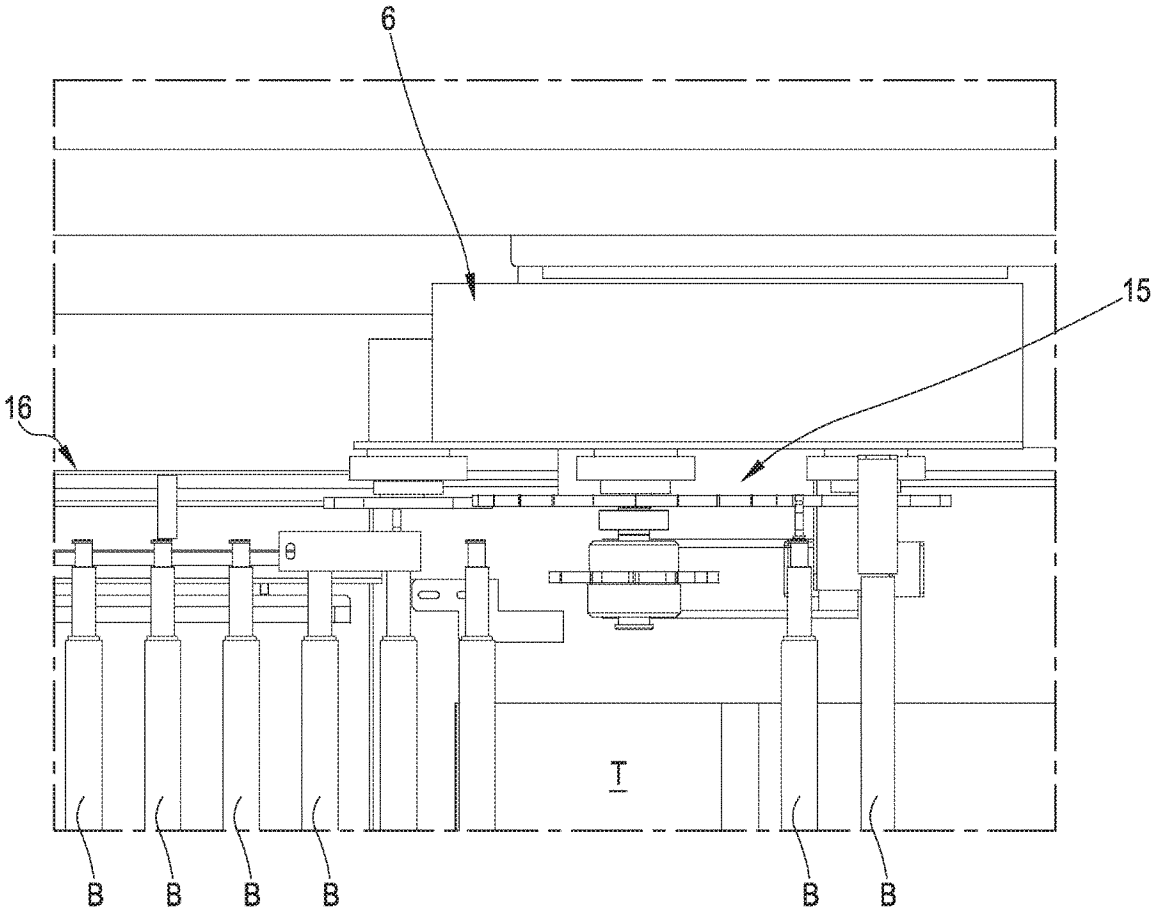
FIG. 9 is a view relative to a detail in FIG. 8.

As is visible in FIGS. 5 to 7, the first and second idler rolls 11, 12 are configured for rotating—under operative conditions of the device 1—about respective horizontal parallel axes and are placed at different heights in order to provide the upper section 13 of the belt itself with a predetermined slope. For example, the rotation axis of the first idler roll 11 can be placed at a height less than the height at which the second idler roll 12 is placed, providing the upper section 13, or at least a longitudinal portion of this latter, with a flat surface shape having a slope, with respect to a horizontal plane, greater than 5°, particularly between 10° and 45°, still more particularly between 10° and 30°.

The conveying belt can be engaged only with first and second rolls 11 and 12, or one or more intermediate idler or tensioning rolls (FIGS. 2 and 4) can be provided along the closed path of the conveying belt. For example, the tensioning roll 24 is arranged to press against the lower section of the belt for adjusting the tension of the belt.

If the conveying element 8, as in FIGS. 1 to 7, is a conveying belt, it is possible to provide the supporting portion 23 adapted to support the surface portion 22, with one or more distinct overlapped continuous layers. Alternatively, the conveying belt could be only formed by the absorbing surface portion 22 without further supporting layers or portions: in this case, the absorbing surface portion would actually coincide with the conveying belt 8 having a side engaged with the rolls 11 and 12 and a side contacting the fibrous material T.

In the illustrated condition in which the element 8 is a conveying belt 8, the inlet port 4 of the casing 2 can define a single through opening enabling the upper section and lower section of the belt to pass through. However, in another embodiment, the inlet port 4 defines a first through slit for passage of only the upper section 13 of the belt (the belt return section moves along a direction entering the chamber 3) and a second slit spaced and distinct from the first slit, for passage of the belt lower section 14 (the belt return section moves along a direction exiting from the chamber 3). In this latter configuration, illustrated for example in FIGS. 2, 5-7, the inlet port 4 minimizes the size of the passage hole of the belt through the casing lateral wall in order to avoid high steam losses (leaks) from the chamber 3.

Figure 10:
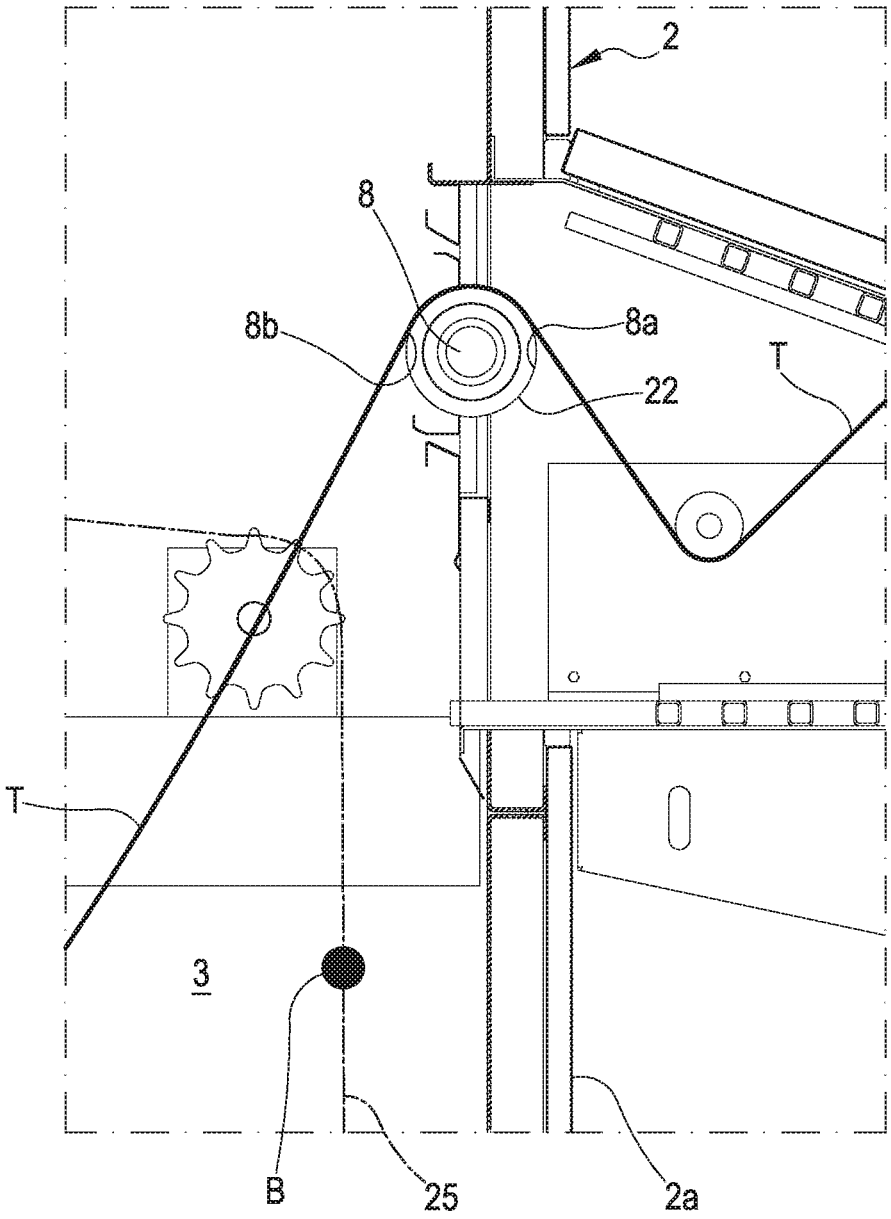
FIGS. 10 and 11 are schematic views of respective embodiment variants of a vaporizer.

While the majority of the attached figures show a belt as conveying element, it is possible to use a conveying element 8 of another type, for example, shaped as a drum engaged at the inlet port 4 (FIG. 10). Further juxtaposed axial drums can be also provided: the one or more drums operate at the inlet port in order to constantly present a first portion 8*a* outside the treatment chamber 3 and a second portion 8*b* inside the chamber 3. In such configuration, the/each conveying drum can be symmetrically placed at the inlet port so that the perimetral extension of the portions 8*a* and 8*b* is substantially identical (FIG. 10). However, it is possible to place the conveying drum with an asymmetrical configuration with respect to the inlet port 4 so that the perimetral extension of the portions 8*a* and 8*b* is different (this configuration is not illustrated in the attached figures). The surface of the at least one conveying drum is coated by a portion 22 so that the same can directly receive the material T, pre-humidify it outside the chamber, and guide it inside the chamber. The structure and the features of the absorbing surface portion 22 are as previously described.

Figure 11:
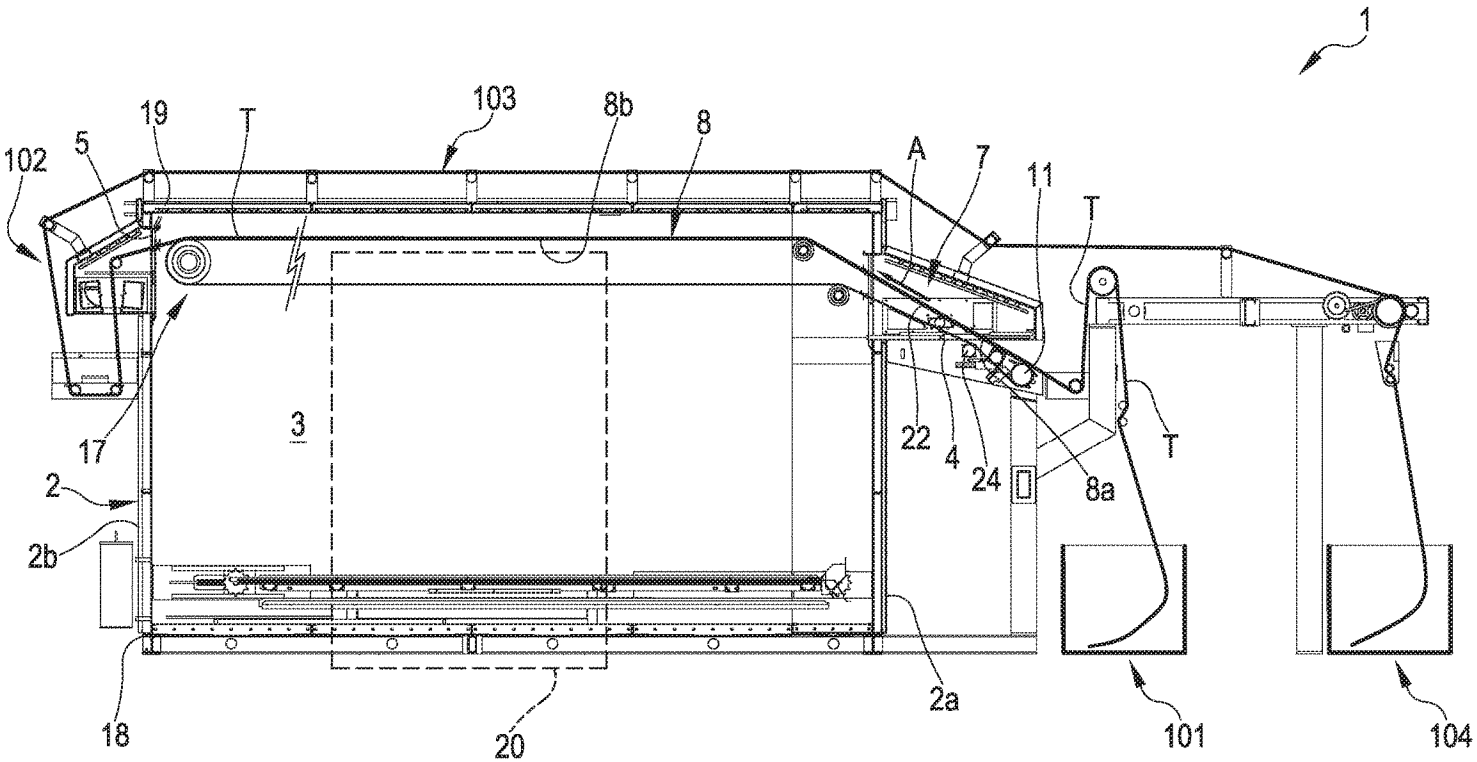

A further example of conveying element 8 is illustrated in FIG. 11, in which the element includes one or more conveying belts having a first portion 8*a*, extending outside the treatment chamber 3, configured for directly receiving the fibrous material T, and a second portion 8*b* configured for guiding the material into the chamber 3. More specifically as shown in FIG. 11, the second portion 8*b* exhibits a perimetral extension greater than the one of the first portion 8*a*: in this way, the second portion 8*b* enables both to introduce the sheet material T into the chamber 3 and to guide the material T into the treatment chamber 3 for at least a portion of, possibly all of, the operative path. FIG. 11 illustrates a configuration of the element 8 exhibiting a single conveying belt, the second portion 8*b* of the belt extends from the inlet port 4 to the outlet port 5: the sheet fibrous material T is completely guided all along the operative path of the conveying belt. Further, it is possible to provide the element, inside the chamber 3, with a plurality of conveying belts overlapped on each other in order to form a serpentine path of the sheet material T: the belts are configured for guiding the sheet material from the inlet port 4 to the outlet port 5 along the serpentine operative path. The single conveying belt or the plurality of belts is coated, at the top, by the absorbing surface portion 22; the belt portion 8*a* placed outside the chamber is adapted to pre-humidify the fibrous material T lying on the portion 8*a*, while the second portion 8*b* (having a perimetral extension greater than the first portion 8*a*) guides the material along the operative path inside the chamber 3. With reference to FIG. 11, the structure and features of the absorbing surface portion 22 can be as previously described.

When the conveying element is of the type shown in FIGS. 1-7 and 10, further operative systems are provided inside the treatment chamber 3 for moving the fibrous material T. As visible in FIG. 2, for example, the steam-treatment device 1 can include a guiding device 6 disposed inside the treatment chamber 3 and configured to receive and guide the sheet fibrous material T along a predetermined operative path between the inlet port 4 and outlet port 5 of the casing 2.

For example, the guiding device 6 can include a collecting device 15 (FIGS. 5 to 7) placed at the inlet port 4 of the casing 2 and configured to receive the sheet fibrous material T entering the treatment chamber 3. Preferably, such device 15 is configured to receive the sheet material T falling from the second portion 8*b* of the element 8 and to place it in a loop configuration. More specifically, the collecting device 15 includes a first track 25 on which a series of elongated elements or "sticks" B adapted to directly receive the fibrous material T are caused to continuously move. The track 25 causes the sticks B to pass below the element 8; the sticks B receive the sheet material falling inside the chamber (the fibrous material T falling from the second portion 8*b*). The falling material and the moving sticks B together cause the sheet material T to be placed according to one or more loops. Further, the collecting device 15 is configured to supply the sticks B, arriving from track 25, to a movement device 16 placed downstream the collecting device 15 along the predetermined operative path the fibrous material travels when inside the treatment chamber 3. The movement device 16 includes a second track 26, for example rectilinear and substantially horizontal. The device 16 is configured to collect the sticks B and align them along the second track 26: in this way, the loops defined by the sticks B arriving from the collecting device 15 are close, equidistant and aligned along the material T operative path.

Further, the guiding device 6 includes a discharge device 17 (FIG. 1) immediately downstream from the moving device 16 and at outlet port 5. Such device 17 is configured to individually receive the loops exiting from the movement device 16 and to guide the sheet fibrous material T outside the casing 2 through the outlet port 5. As visible in FIG. 1, the guiding device 6 also includes a third return track 27 configured to withdraw the sticks B exiting from the movement device 6 and take them back to the collecting device 15. The first, second and third tracks (25, 26 and 27) define a closed recirculation path for the sticks B, which are continuously moved between the devices 15, 16 and 17.

An apparatus for fixing ink on sheet fibrous materials T includes a station 101 receiving the printed fibrous material T by a printing process, for example a digital and/or silk-screen printing process. The station 101 can directly receive the material from one or more printing stations or, as illustrated for example in FIGS. 1 and 2, can define a station in which the printed material T is stored. The receiving station 101 is placed immediately upstream of inlet station 7, and provides one or more idler rolls adapted to lay the fibrous material. The receiving station 101 is configured to take the printed sheet fibrous material T to the inlet station 7 of the steam-treatment device 1 and lay it onto the first portion 8*a* of the conveying element 8.

Further, the apparatus includes a steam-treatment device 1 as described above. The printed sheet material T is introduced into the casing 2 through the inlet system 7 and is guided into the treatment chamber 3 along the operative path. The printed material T passing into the chamber 3 is subjected to an ink-fixing process by the presence of steam (saturated steam) under pressure and temperature conditions to cause the ink to be fixed to the material fibres.

As is visible in FIG. 2, for example, the apparatus also includes a station 102 withdrawing the fibrous material T exiting from the steam-treatment device 1; such withdrawing station also includes a plurality of idler rolls adapted to keep the material T taut. The withdrawing station 102 can be associated with a drying station (not illustrated) or can directly provide the material to a return station 103 (FIG. 2). The return station 103 is engaged above the steam-treatment device 1 and, preferably, above the closure wall 19. The return station 103 is configured to move the printed fibrous material T having the fixed ink along a return path from the outlet port 5 to the inlet port 4 of the steam-treatment device 1 according to a direction opposite to the movement of the material inside the chamber 3. Advantageously, the return station 103 is adjacent and close to the heating system 21 of the closure wall 19: preferably, the return station 103 is configured to cause the fibrous material T (printed and having the steam-fixed print) to pass in proximity of and parallel to the heating system so that this material can, during the movement, receive heat and therefore dry.

As further visible in FIG. 2, the apparatus also includes a storing station 104 placed downstream of the return station 103 and configured to store the fixed printed fibrous material exiting the steam-treatment device 1.

A process of fixing ink on sheet fibrous materials, for example on fabrics and/or non-woven fabrics, which have been previously subjected to one or more printing processes, can be performed by means of the above described steam-treatment device 1. The process includes a step of transporting the sheet fibrous material T inside the chamber 3. Such step preferably includes laying the sheet material T on the first portion 8*a* of the element 8. Moving the element 8 conveys the material T on portion 8*a* into the casing 2, where the printing ink is steam-fixed. The process includes a step of pre-humidifying the sheet fibrous material T outside the treatment chamber 3 by causing the material T to contact the absorbing surface portion 22 of the inlet station 7 and consequently the sheet fibrous material T absorbs a portion of the water contained in the absorbing surface portion. Actually, the sheet fibrous material T is placed on the conveying belt surface portion 22 and, while it travels to the inlet opening 4, receives part of the water contained in the surface portion 22. More particularly, it is noted that the surface portion extends along the active surface of the conveying element, and thus the absorbing surface portion 22 exhibits at least one section constantly operating inside and a section operating outside the treatment chamber 3. While the conveying element 8 moves, consecutive parts of the absorbing surface portion 22 are cyclically caused to (1) move inside the treatment chamber 3, where a saturated steam environment penetrating in the part of the surface portion 22, inside the treatment chamber 3, prevails; (2) move outside the treatment chamber 3, where water condenses at the part of the absorbing surface portion 22 outside the chamber 3 itself; and (3) contact the fibrous material to transfer at least a fraction of the condensate water trapped by the part of the absorbing surface portion 22 outside the chamber 3 itself, to the fibrous material.

It is specified that the sheet fibrous material exhibits two main opposed sides: in many cases, the sheet material is printed only on one of said sides and exhibits an unprinted side, opposite the printed side; in such cases, only the unprinted side directly contacts the absorbing surface portion, so that the water is uniformly absorbed without moving to the printed side.

After pre-humidifying the sheet fibrous material T, the inlet system 7 guides the material T inside the treatment chamber 3 (inside the casing 2). The fibrous material T is guided into the chamber 3 along a predetermined operative path during which it is steam-treated. More specifically, the fibrous material is caused to fall on the collecting system 15, which arranges the material T according to a configuration with one or more loops. Particularly, the pre-humidified material T is caused to fall over sticks B moving along a first track 25 towards the outlet port 5: moving the sticks and simultaneously causing the material to fall on the second portion 8*a* of the element arranges the material according to one or more loops, as schematically sequentially represented in FIGS. 5 to 7.

Then, the collecting device 15 provides the sticks (with the respective loops) to the movement device 16, which collects and aligns the sticks B along the second track; the movement device causes the sticks B to slide along a predetermined path, for example a rectilinear horizontal path.

Afterward, the material exiting from the movement device 16 is withdrawn by the discharge device 17, which opens up the loops and guides the sheet fibrous material exiting from the chamber 3, through port 5.

Steam is present in the chamber 3, preferably saturated steam, which acts on the passing fibrous material for fixing the ink. The steam is directly introduced into the chamber by one or more generators 20. Advantageously, the saturated steam is introduced to the treatment chamber 3 at a temperature comprised between 100 and 130° C., preferably between 100 and 120° C., still more preferably between 100 and 110° C. More specifically, supplying steam by the generator 20 is performed at a pressure comprised between 1 and 1.7 bar, preferably between 1 and 1.5 bar. Once the standard conditions are met inside chamber 3, saturated steam is present, with temperature and pressure approximately as supplied by the generator 20. The fibrous material inside the treatment chamber 3 is steamed by maintaining a ratio between 0.5 and 1 of the saturated steam.

The process can be performed by a first procedure by which the material, previously printed in one or more printing stations remote from the device 1, is stored in one receiving station 101 placed at the inlet station 7. Under such condition, the printed material is collected by the receiving station, laid down for example by a series of idler rolls, and then provided to the inlet station 7. Alternatively, the fixing process can be directly performed immediately after a printing process or a drying process following a printing process. In the direct process, the printed fibrous material T can directly arrive from one or more printing apparatuses or directly from a drying apparatus: the printed fibrous material is therefore immediately provided to the inlet station 7 without storing in an intermediate station.

At the end of the ink-fixing steps (or of the material steaming step), the process can include a step of delivering the fixed material to a drying station that causes the material T to dry. Alternatively, the process can include a step of pre-drying the material in which the material, exiting from casing 2 port 5, is guided above closure wall 19, sliding near the heating system 21 of the same wall 19. The passage of the material T at the heating system 21 enables at least partial drying of the material T. After the step of pre-heating the printed fibrous material T having the fixed ink, the process can include a step of continuously delivering it to a drying station, or can include collecting the pre-dried material in a storing station 104 (FIG. 2).

What is claimed is:

1. A printed fibrous sheet material steam treatment apparatus, comprising:

a casing defining at least one steam-treatment chamber and having at least one inlet port, configured for enabling introduction of a fibrous sheet material into the treatment chamber, and at least one outlet port configured for enabling the treated fibrous sheet material to exit from the treatment chamber;

at least one conveyor configured to contactingly receive the fibrous sheet material and convey the material into the treatment chamber through the inlet port, the conveyor being positioned with respect to the inlet port so as to constantly present a first conveyor portion disposed outside the treatment chamber and a second conveyor portion extending inside the treatment chamber; and wherein the conveyor includes at least one absorbing surface arranged to contact the fibrous sheet material as placed on the conveyor, the absorbing surface being configured to capture condensate water.

2. The steam treatment apparatus of claim 1, wherein the conveyor has an active surface arranged to contactingly receive the fibrous sheet material and which extends along a closed path; and wherein the absorbing surface comprises at least one continuous absorbing layer extending along all the closed path of the active surface of the conveyor.

3. The steam treatment apparatus of claim 2, wherein the conveyor comprises a conveying belt or a conveying drum.

4. The steam treatment apparatus of claim 1, wherein at least the absorbing surface of the conveyor comprises a fibrous material having a dry specific weight less than 1 $kg/m^2$ per 1 mm of thickness, as measured in a standard environment at a temperature of 288.15 K (15° C.), pressure of 101.325 kPa (1 atm), and humidity of 0.00.

5. The steam treatment apparatus of claim 1, wherein the absorbing surface has a water absorption capacity greater than 25%, by weight, of a dry weight of the absorbing surface, per unit volume.

6. The steam treatment apparatus of claim 1, wherein each 0.5 $cm^3$ of volume of the absorbing surface defines a plurality of recesses in the form of at least one of pores, channels extending through an entire thickness of the absorbing surface, and interstices extending only partially through a thickness of the absorbing surface, and wherein a plurality of said recesses are open on an exposed surface of said absorbing surface.

7. The steam treatment apparatus of claim 6, wherein the surface comprises hydrophilic material.

8. The steam treatment apparatus of claim 1, wherein the conveyor comprises a conveyor belt engaged as a closed loop about at least a first idler roll outside the treatment chamber and a second idler roll inside the treatment chamber, the conveyor belt comprising at least one upper belt section extending between the first and second idler rolls and arranged to contact and convey the fibrous sheet material into the treatment chamber, and at least one lower belt section.

9. The steam treatment apparatus of claim 8, wherein the first and second idler rolls are configured to rotate about respective horizontal axes parallel to each other and placed at different heights, wherein the rotation axis of first idler roll is lower than the rotation axis of the second idler roll, such that the upper belt section is inclined at an angle of more than five degrees with respect to a horizontal plane, and wherein a longitudinal extent of the second portion of the conveyor, measured parallel to an advancement direction of the conveyor, is greater than a longitudinal extent of the first portion of the conveyor.

10. The steam treatment apparatus of claim 1, comprising at least one material guide disposed inside the treatment chamber and configured to receive the fibrous sheet material from the conveyor and to guide the fibrous sheet material along an operative path inside the treatment chamber, from proximate the conveyor to the outlet port.

11. The steam treatment apparatus of claim 1, wherein the guide comprises:

a fibrous sheet material collector configured to arrange the fibrous sheet material entering treatment chamber into one or more bends;

a fibrous sheet material mover downstream of the collector along a predetermined operative path of the fibrous sheet material, the mover configured to receive and advance the bends of sheet material along a predetermined direction; and a discharger configured to receive fibrous sheet material exiting the mover and to guide the fibrous sheet material out of the casing through the outlet port.

12. The steam treatment apparatus of claim 1, comprising at least one steam generator configured to generate and supply steam to the treatment chamber;

wherein the steam generator is configured to generate saturated steam and to maintain inside the treatment chamber a temperature between 100 and 130° C., and to maintain inside the treatment chamber an absolute pressure between 1 and 1.7 bar.

13. A method of fixing ink on a fibrous sheet material having at least one printed side, comprising:

conveying printed fibrous sheet material into a steam-treatment chamber on a conveyor having an absorbing surface, the printed fibrous sheet material carrying an ink;

steam fixing the ink to the fibrous sheet material in the steam-treatment chamber, by guiding the fibrous sheet material along a predetermined operative path between an inlet port and an outlet port of the chamber, thereby treating the fibrous sheet material; and extracting the treated fibrous sheet material from the outlet port;

wherein the method includes pre-humidifying the fibrous sheet material outside the steam-treatment chamber, by:

bringing the fibrous sheet material into contact with the absorbing surface of the conveyor, the absorbing surface containing condensate water; and transferring into the fibrous sheet material at least a portion of the condensate water from the absorbing surface.

14. The method of claim 13, wherein the conveyor contactingly receives and conveys the fibrous sheet material into the steam-treatment chamber through the inlet port, while constantly presenting a first conveyor portion disposed outside the treatment chamber and a second conveyor portion extending into the treatment chamber; and wherein during the pre-humidifying:

the fibrous sheet material is brought into contact with the absorbing surface of the first conveyor portion; and the portion of condensate water is transferred into the fibrous sheet material while the fibrous sheet material is conveyed by the conveyor.

15. The method of claim 13, wherein consecutive parts of the absorbing surface are cyclically made to:

move into the treatment chamber, where an environment of saturated steam penetrates the surface portion;

move out of the treatment chamber, where water condenses to form liquid water contained within the absorbing surface; and to contact the fibrous sheet material and transfer at least a portion of the condensed water from inside the absorbing surface to the fibrous sheet material.

16. The method of claim 13, wherein the fibrous sheet material has two main opposite sides and is printed on only one of said sides, such that the fibrous sheet material has an unprinted side placed in direct contact with the absorbing surface.

17. The method of claim 13, wherein steam fixing comprises:

introducing steam into the treatment chamber, including controlling introduction of steam into the treatment chamber to maintain:

a temperature between 100 and 130° C., and an absolute pressure between 1 and 1.7 bar.

18. The method of claim 13, wherein steam fixing comprises:

receiving pre-humidified fibrous sheet material into the treatment chamber;

withdrawing the received fibrous sheet material by a material collector;

delivering, by the collector, the withdrawn fibrous sheet material to a mover that guides the sheet material along the predetermined operative path; and withdrawing the fibrous sheet material from the mover by a discharger that guides the treated fibrous material from the treatment chamber through the outlet port.

* * * * *